United States Patent [19]

Eatherton

[11] 4,424,753

[45] Jan. 10, 1984

[54] PALLET OF COMPOSITE CONSTRUCTION

[75] Inventor: John R. Eatherton, Sacramento, Calif.

[73] Assignee: Down River International, Inc., Sacramento, Calif.

[21] Appl. No.: 405,224

[22] Filed: Aug. 5, 1982

[51] Int. Cl.[3] ..... B65D 19/34; B32B 3/28

[52] U.S. Cl. ..... 108/51.1; 108/56.1; 428/119; 428/182; 428/184; 428/186; 428/188

[58] Field of Search ..... 108/51.3, 57.1, 51.1, 108/56.1; 248/346; 206/386; 428/119, 182, 184, 186, 188

[56] References Cited

U.S. PATENT DOCUMENTS

| | | | |
|---|---|---|---|
| 2,388,730 | 11/1945 | Fallert | 108/51.3 |
| 2,446,914 | 8/1948 | Fallert et al. | 108/57.1 |
| 2,583,443 | 1/1952 | Perry et al. | 108/57.1 |
| 2,702,682 | 2/1955 | Newsom | 108/51.3 |
| 2,904,297 | 9/1959 | Hamilton | 108/51.3 |
| 3,464,371 | 9/1969 | Gifford | 108/51.3 |
| 4,319,530 | 3/1982 | Moog | 108/56.1 |

*Primary Examiner*—Paul J. Thibodeau

*Attorney, Agent, or Firm*—Townsend and Townsend

[57] ABSTRACT

A pallet of composite construction comprising top and bottom panels of corrugated paperboard, at least two runners of stacked corrugated paperboard disposed on end between the panels, and at least two wooden stringers residing in notches in the runners and extending transversely of the runners. The runners and the stringers form a grid for supporting the top panel. Alternative constructions of the invention are described in detail in the specification.

3 Claims, 2 Drawing Figures

PALLET OF COMPOSITE CONSTRUCTION

BACKGROUND AND SUMMARY OF THE INVENTION

Pallets are widely used for the transportation of a wide variety of goods. An essential purpose of a pallet is to provide a support platform for the goods which allows a space below the goods for entry of the forks of a forklift. By far, the most popular pallet construction material is wood. A wooden pallet typically features a wooden platform and two or three wooden runners beneath the platform which provide for fork entry. Because of the cost of wood, it is usually economically necessary to reuse wooden pallets. Reuse often entails the expense of returning the empty pallets to the original shipment point.

It has long been the desire of the pallet industry to provide a pallet which is sufficiently inexpensive so that reuse is not necessary. In other words, the pallet would be discarded after its first use. There have been many attempts to design such a pallet, often using corrugated paperboard as the construction material. Examples of such pallets are formed in the patents to Fallert, U.S. Pat. No. 2,388,730; Fallert et al., U.S. Pat. No. 2,446,914; and Gifford, U.S. Pat. No. 3,464,371. There have also been attempts to design pallets which are fabricated from a combination of corrugated paperboard and wood stringers. This type of pallet is illustrated in the patents to Newsom, U.S. Pat. No. 2,702,682, and Hamilton, U.S. Pat. No. 2,904,297.

The present invention provides an improved patent of composite construction. The preferred materials are corrugated paperboard and wood. In its preferred form, the pallet has upper and lower panels of corrugated paperboard. Two or more runners are disposed between the upper and lower panels which are preferably fabricated from stacked corrugated paperboard. The corrugation of the runners are disposed vertically between the upper and lower panels, i.e., the edges of the corrugated paperboard mate with the upper and lower panels. The runners are notched to receive two or more wood stringers which extend transversely of the runners. The depth of the notches is substantially the same as the thickness of the stringers so that the upper surface of the wooden stringers lies flush with the upper surface of the runners to form a grid lying in an even plane for supporting the upper panel of corrugated paperboard.

The composite pallet as described above has a number of advantages, chief among these are low cost and light weight. Of course, low cost is an essential requirement if the pallet is to be disposable after a single use. Furthermore, light weight is highly desirable since pallets create parasitic weight. Often, the weight of the pallet adds to the cost of shipment of the goods supported by the pallets.

The advantages of the present invention are in part due to the grid formed by the notched runners and the wood stringers. The grid efficiently supports the upper panel to support and facilitate the shipment of heavy goods. Moreover, the wood used as transverse stringers has superior bending strength for a given thickness as compared to the corrugated stringers. Therefore, sufficient clearance can be provided beneath the wood stringers to provide for the entry of the forks of a forklift. The attachment of the wood stringers and corrugated runners maintains the spacing and relationship of the runners and prevents the tops of the runners from skewing under load; i.e., tilting relative to a perpendicular relationship with the top and bottom panels. Similarly, the bottom panel ties the lower surfaces of the corrugated runners together to prevent such skewing.

The various components of the composite pallet of this invention functionally interrelate to provide a low-cost, light-weight pallet. Although the pallet construction is sufficiently low in cost so as to be disposable after the first use, at the same time, it is sufficiently durable to allow reuse if desired. Other advantages and features of the composite pallet according to the present invention will be apparent in view of the Detailed Description of the Preferred Embodiment.

DETAILED DESCRIPTION OF THE PREFERRED EMBODIMENT

Figure 1:
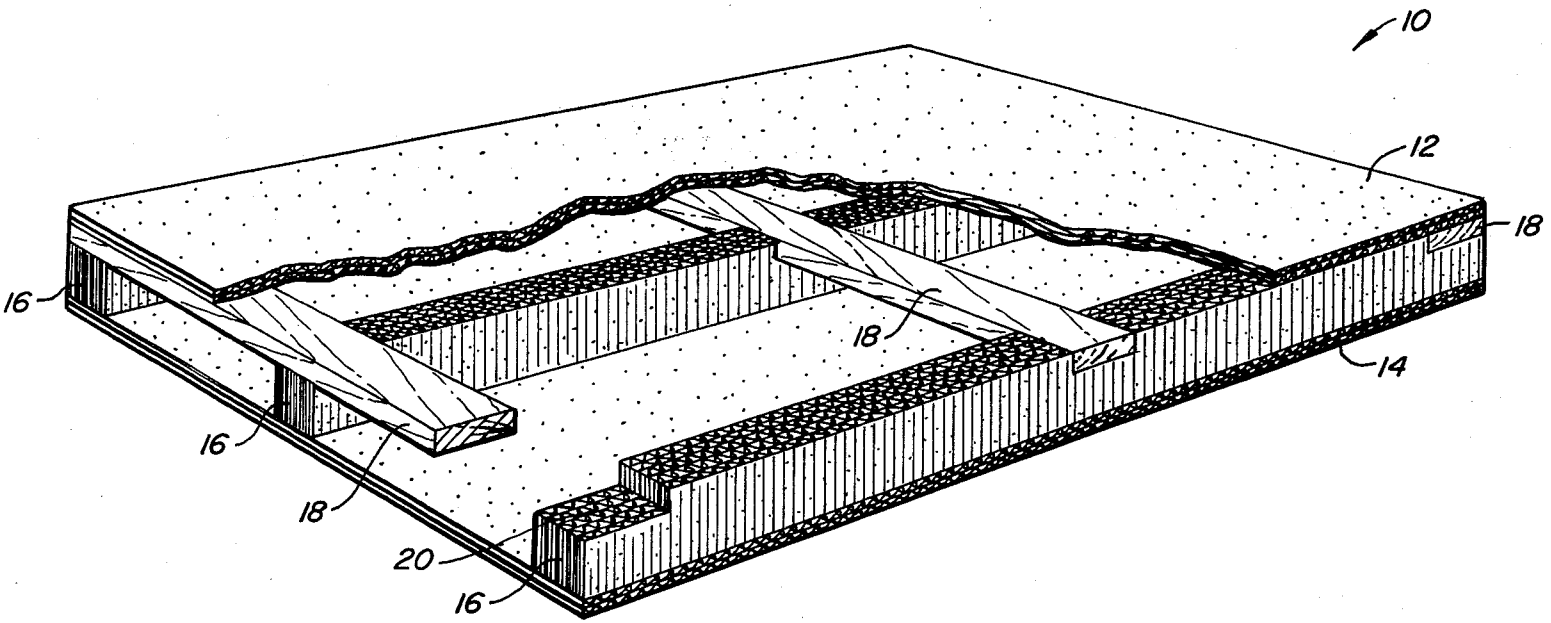
FIG. 1 is a perspective, partially cut-away, illustration of the preferred embodiment of a composite pallet according to the present invention.
Figure 2:
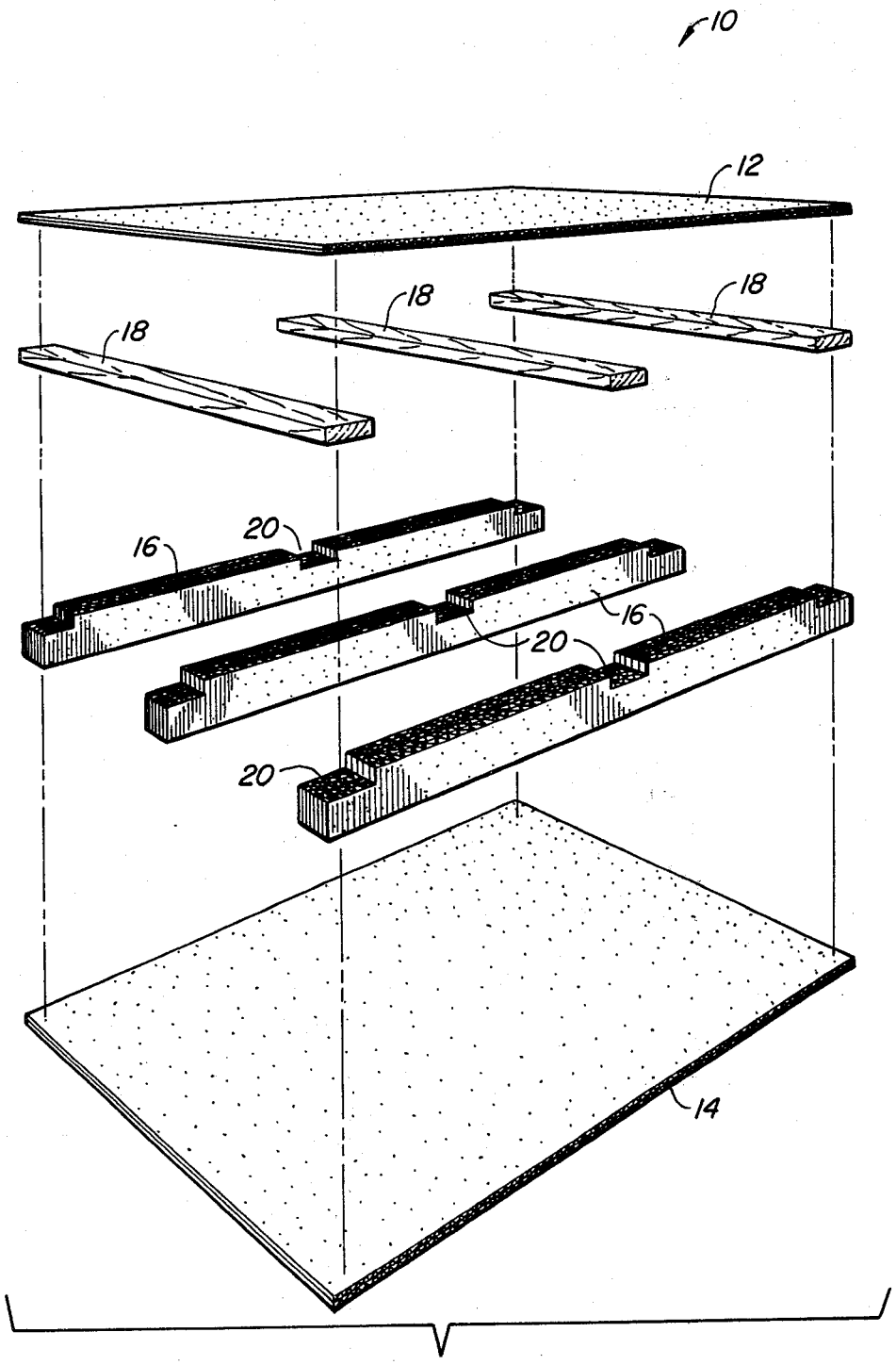
FIG. 2 is a perspective, exploded illustration of the pallet of FIG. 1, showing the individual components of the pallet.

In FIG. 1, the preferred embodiment of a composite pallet 10 of the present invention is illustrated. The pallet 10 has an upper panel 12 and a lower panel 14. The upper and lower panels 12 and 14, respectively, are preferably constructed from corrugated paperboard. In light-duty applications, the panels 12 and 14 can be a single layer or ply of corrugated paperboard. In heavier duty applications, multiple layers or plies can be used. The criteria for selecting the number of layers of the upper panel 12 and the lower panel 14 are discussed in detail hereinafter.

Disposed between the upper panel 12 and the lower panel 14 are three runners 16. As shown in the figures, the runners 16 are constructed of a stack of corrugated paperboard with the plies of the paperboard arranged vertically. That is to say, the open edges of the paperboard face upwardly and downwardly to mate with the upper panel 12 and the lower panel 14, respectively. The vertical orientation of the plies maximizes the resistance to bending of the runners 16 about axes perpendicular to the runners 16. The number of plies in each runner 16 is chosen depending upon the bending strength required of the runner 16. Although three runners 16 are shown, two runners 16 may be used, or alternatively, more than three runners 16 may be used, depending upon the size of the pallet and the weight the pallet must support. The runners 16 have a sufficient height to provide adequate clearance for the forks of a forklift.

The runners 16 have notches 10 in their upper surfaces which receive wooden stringers 18. In the preferred embodiment, the stringers 18 extend perpendicularly with respect to the runners 16 to form a rectangular grid. However, the stringers 18 may extend transversely of the runners 16 at an angle other than 90° to form a diamond-shaped grid. The notches 20 are as deep as the thickness of the stringers 18 so that the upper surfaces of the stringers 18 are in substantially the same plane as the upper surfaces of the runner 16. Preferably, the width of the notches 20 are sized to closely match the width of the stringers 18, thereby resisting parallelogramming of the pallet 10. In the particular embodiment shown, three stringers are used. However, as with the case of the runners 16, two stringers 18 may be used or more than three stringers 18 may be used, depending upon the size of the pallet and the weight of the goods to be carried by the pallet. Since the wood stringers 18 have substantial bending strength even though the thickness of the wood stringer 18 is substantially less than the thickness of the corrugated runner 16, sufficient space can be provided below the wood stringers 18 to allow entry of the forks of a forklift.

In the preferred embodiment, to provide maximum support for the panel 12, the outermost runners 16 and the outermost stringers 18 are flush with the edges of the upper and lower panels 12 and 14. The remaining runner 16 and the remaining stringer 18 are centrally disposed with repect to the panels 12 and 14.

Preferably, the components 12–18 of the pallet 10 are joined by gluing. Adhesives of the solvent type, the hot-melt type or the polymer-reaction type may be used. In applications which would expose the pallet 10 to moisture, a water-resistant adhesive is preferred. Optionally, other attachment means can be used. For example, the upper panel 12 may be conveniently stapled to the wooden stringers 18.

It should be noted that the grid formed by the upper surfaces of the wooden stringers 18 and the upper surfaces of the corrugated runner 16 provides efficient support of the upper panel 12. As a result, relatively heavy loads can be carried by the pallet 10 without detrimental deformation of the upper panel 12. By way of comparison, consider a pallet construction having the runners 16 only, without the stringers 18. Such a construction would provide little resistance to folding of the upper panel 12 along a line parallel to the runners 16. Such folding is resisted by the transverse stringers 18.

The number of plies of the upper panel 12 is selected in accordance with the weight of the goods to be carried by the pallet 10. Additionally, consideration is given to whether the load will be uniformly spread over the surface of the panel 12 or whether the load may be concentrated at restricted locations on the upper panel 12. Furthermore, the spacing of the runners 16 and the stringers 18 are taken into consideration in selecting the number of plies of the upper panel 12.

The wood stringers 18 provide a number of additional advantages. For example, they tend to lock the runners 16 in position with the end portions and mid-portions of the runners 16 held in equal-spaced relationship as shown. The wood stringers 18 resist parallelogramming and prevent the upper part of the runners 16 from being bent inwardly or outwardly when viewed from above. Still additionally, the wood stringers 18 resist bending of the pallet 10 about the axes perpendicular to the stringers 18.

The runners 16, on the other hand, resist bending of the pallet 10 about axes perpendicular to the runner 16. The runner 16 also provides the necessary clearance below the stringers 18 to allow entry of the forks of a forklift. Importantly, the height of the runner 16 which facilitates the entry of the forks also endows the runners 16 with bending resistance. Since the runners 16 are formed of corrugated paperboard, the necessary height of the runners can be achieved at relatively low cost as compared with other materials such as wood. Of course, the number of plies of the runners are selected to provide the necessary bending resistance, taking into account the beneficial effect of the height of the runners 16.

The lower panel 14 is principally used to provide a fixed spacing between the bottoms of the runner 16, i.e., to prevent inward or outward bending of the runners 16 when viewed from the bottom. Inward and outward bending of the runners 16 stresses the attachment of the stringers 18 and the runners 16 at the notches 10. Since bending moments applied to the bottoms of the runner 16 are magnified at the top, the attachment of the stringers 18 and the runners 16 can be deleteriously affected by bending forces applied to the bottoms of the runner 16. If the lower panel 14 were not provided, the pallet construction would be necessarily heavier and costlier in order to resist bending forces applied to the bottoms of the runners 16; for example, when the bottom of the runners 16 are struck from the side during use of the pallet 10. The lower panel 14 advantageously resists the bending forces at the bottom of the runners 16, as opposed to the top of the runners 16, thereby much more efficiently opposing the bending forces. Moreover, the smooth surface provided by the bottom panel 14, in and of itself, tends to minimize the number of occasions on which the bottoms of the runners 16 are struck from the side thereby limiting the frequency at which bending forces are applied to the bottoms of the runners 16.

It will be appreciated that the number of plies of the bottom panel 14 is selected predominantly in accordance with the functions of maintaining the spacing of the bottoms of the runners 16 and resisting bending forces applied to the runners 16. As in the case of the upper panel 12, the number of plies of the bottom panel 14 can vary widely.

In one embodiment of a pallet according to the present invention, the following components were used:

Upper panel 12: corrugated paperboard, 48×40 inches, two plies.

Lower panel 14: corrugated paperboard, 48×40 inches, two plies.

Runners 16: corrugated paperboard, 3 inches thick, $3\frac{1}{8}$ inches high, 20 plies.

Stringers 18: wood, $3\frac{1}{2}\times\frac{3}{4}$ inches, 40 inches long.

Notches 20: $3\frac{1}{2}\times\frac{3}{4}$ inches.

When viewed as a whole, it will be appreciated that the elements of the composite pallet 10 cooperate to provide high structural efficiency. That is to say, a pallet of low weight but of great strength is constructed from relatively low-cost components.

Although only a preferred embodiment of the composite pallet according to the present invention has been described, it will be appreciated by those skilled in this art that modifications and variations are possible without departing from the basic invention. For that reason, the scope of the invention should be measured by the appended claims.

I claim:

1. A composite pallet comprising:

at least two generally parallel runners, each having an upper surface and a lower surface, said runners being formed of a plurality of stacked plies of corrugated paperboard with the plies extending vertically between the upper and lower surface and each having at least two notches in its upper surface, the depth of said runners beneath said notches being sufficient to allow entry therebeneath of the forks of a forklift for lifting said pallet;

at least two stringers constructed of wood residing in the notches of said runners and extending transversely of the runners, the thickness of said stringers being substantially the same as the depth of said notches so that the upper surfaces of said stringers are substantially in the same plane as the upper surfaces of said runners and so that the upper surfaces of said runners and the upper surfaces of said stringers form a substantially flat grid for supporting an upper panel;

an upper panel of corrugated paperboard disposed on said grid formed by the upper surfaces of said runners and said stringers and being secured thereto; and a lower panel of corrugated paperboard disposed on the lower surfaces of said runners and being secured thereto.

2. A composite pallet according to claim 1 wherein said stringers are disposed perpendicularly with respect to said runners.

3. A composite pallet according to claim 1 having three of said generally parallel runners and three of said stringers.

* * * * *